United States Patent [19]

Kuze et al.

[11] 4,119,761

[45] Oct. 10, 1978

[54] HEAT RADIATION ANODE

[75] Inventors: Takashi Kuze, Yokohama; Toshiharu Matsuki, Kawasaki; Koji Nagaoka, Yokohama; Naoji Iwai, Tokyo, all of Japan

[73] Assignee: Tokyo Shibaura Electric Co., Ltd., Kawasaki, Japan

[21] Appl. No.: 748,362

[22] Filed: Dec. 7, 1976

[30] Foreign Application Priority Data

Dec. 12, 1975 [JP] Japan ..... 50-148912
Dec. 24, 1975 [JP] Japan ..... 50-155379

[51] Int. Cl.[2] ..... H01J 1/38

[52] U.S. Cl. ..... 428/472; 428/913; 148/6.3; 148/6.35; 148/31.5; 427/126; 427/160; 427/427; 427/419 A; 313/355; 313/311; 165/133

[58] Field of Search ..... 148/6.3, 6.35, 31.5; 427/111, 34, 423, 160, 248 C, 419 A, 419 B; 165/133; 244/117 A, 158, 160, 133; 106/57, 66; 313/355, 311; 428/472, 913

[56] References Cited

U.S. PATENT DOCUMENTS

| | | | |
|---|---|---|---|
| 2,442,223 | 5/1948 | Uhlig | 148/6.35 |
| 2,446,277 | 8/1948 | Gordon | 148/6.3 |
| 2,615,141 | 10/1952 | Hansell | 148/6.3 X |
| 2,960,757 | 11/1960 | Epstein | 148/6.3 X |
| 3,377,213 | 4/1968 | Hiller | 148/6.35 |
| 3,437,532 | 4/1969 | Helgert et al. | 148/6.35 |
| 3,540,942 | 11/1970 | Lewis et al. | 427/423 X |
| 3,565,671 | 2/1971 | Teeg et al. | 428/469 X |
| 3,600,146 | 8/1971 | Jensen | 427/423 X |
| 3,620,808 | 11/1971 | Monroe | 427/419 A |
| 3,841,920 | 10/1974 | Martin | 148/6.35 |
| 3,969,153 | 7/1976 | Suzuki et al. | 148/6.35 |
| 4,017,336 | 4/1977 | Foroulis | 148/6.35 |

OTHER PUBLICATIONS

Schatz, Chem. Abstracts, vol. 64:16666d, 1966.
Handbook of Chemistry and Physics, 54th ed., 1973–1974, pp. F-141 - F-142.

*Primary Examiner*—Ralph S. Kendall
*Attorney, Agent, or Firm*—Cushman, Darby & Cushman

[57] ABSTRACT

A heat radiation element has a substrate and a heat radiation layer formed on the substrate by oxides of a chromium-containing alloy. The oxides contain at least 35% by weight of chromium based on the total weight of the metals constituting the oxides.

22 Claims, 1 Drawing Figure

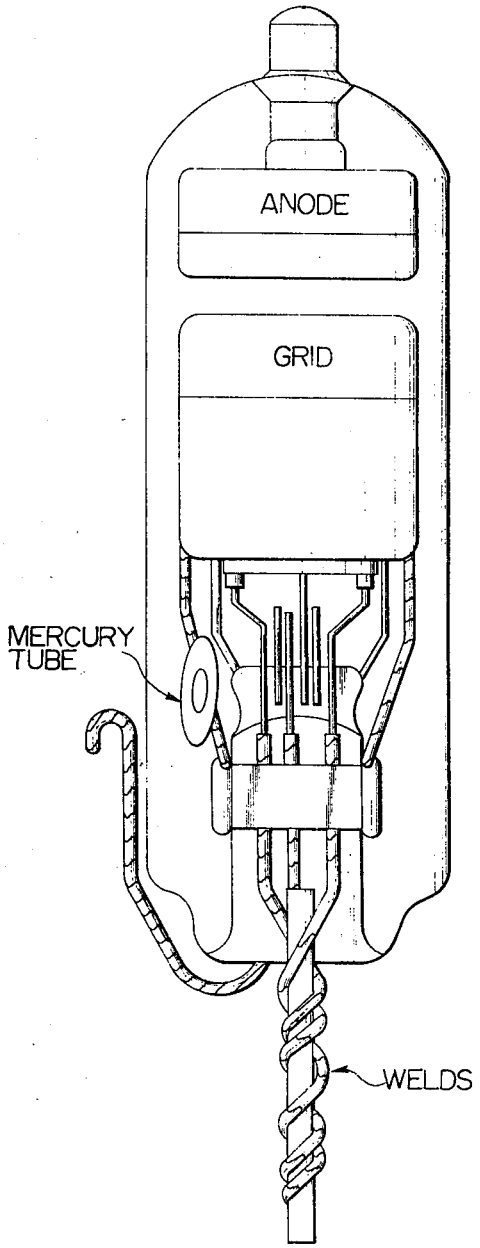
ANODE
GRID
MERCURY TUBE
WELDS

HEAT RADIATION ANODE

BACKGROUND OF THE INVENTION

I. Field of the Invention

This invention relates to a heat radiation element, and more particularly to an element including a substrate and a metal oxide layer formed thereon.

II. Description of the Prior Art

A heat radiation element is extensively used in various fields including the use as internal parts of an electron tube, a heating wire, a heat-collecting member, a heat-dissipating member, etc. For example, the anode of a transmitter valve or a receiver valve is struck by thermoelectrons discharged in operation from the cathode, resulting in heating of the anode. If the temperature elevation by the heating is excessive, the gas occluded in the metal constituting the anode is rapidly discharged. Further, the wall of the valve is also heated, leading to a noticeable discharge of the gas occluded in the wall. Still further, thermal deformation is caused by the heating. The drawbacks mentioned combine to invite deterioration in characteristics of the valves and cause undesirable accidents. Accordingly, it is necessary that the anode be made of a material having a good heat radiation property.

Known heat radiation materials include a so-called soothing material, a material containing intermetallic compounds, etc. The sooting material is prepared by depositing soot generated by burning organic substances such as benzene and acetone in the presence of an insufficient amount of oxygen on a substrate of nickel, iron or iron-nickel alloy. The material thus prepared is satisfactory in terms of its heat radiation property. But, difficulties are presented by troublesome production steps which are carried out under difficult working circumstances. In addition, the attachment of the soot to the substrate is relatively weak; the soot is relatively easily removed from the substrate if simply rubbed.

The material containing intermetallic compounds is prepared by the steps of, for example, cladding aluminum on iron and diffusing the aluminum into the iron so as to form black intermetallic compounds on the surface. The material of this type is also satisfactory in its heat radiation property but, because of its low resistance against high temperatures, fails to provide a satisfactory heat radiation element used in a large electron tube.

SUMMARY OF THE INVENTION

An object of this invention is to provide a heat radiation element high in heat radiation property and resistance against physical shocks.

Another object is to provide a heat radiation element comprising a metal oxide layer.

These and other objects which will be apparent from the following detailed description are attained by a heat radiation element comprising a substrate and a heat radiation layer formed on the substrate by oxides of a chromium-containing alloy, the heat radiation layer containing at least 35% by weight of chromium based on the total weight of the metal components of the oxides.

The heat radiation property of the element is further improved where the oxides further contain at least one of vanadium, titanium, zirconium, and niobium.

BRIEF DESCRIPTION OF THE DRAWING

The FIGURE is a cross-sectional perspective view of an electron tube showing the heat radiation anode element of the invention. Other portions of the electron tube are indicated.

DETAILED DESCRIPTION OF THE PREFERRED EMBODIMENTS

A heat radiation element according to this invention comprises a substrate and a heat radiation layer formed on the substrate. Preferred materials for the substrate include, for example, metals such as iron (including steel), nickel, chromium, copper, aluminum and silver and various alloys such as iron-chormium, nickel-chromium and iron-nickel-chromium alloys. On the other hand, the heat radiation layer is constituted by oxides of a chromium-containing alloy formed in direct contact with the substrate. The oxides constituting the heat radiation layer contain at least 35% by weight, and preferably from 60% to 99% by weight, of chromium based on the total weight of the metals contained in the oxides.

Among the various chromium-containing alloys providing precursor substances of the oxides constituting the heat radiation layer, peferred alloys are iron-chromium alloy, nickel-chromium alloy and iron-nickel-chromium alloy.

The surface roughness of the heat radiation layer should preferably range in general from 0.05 to 30$\mu$, especially from 0.3 to 5$\mu$, as measured by the Japanese Industrial Standard (JIS) B 0601 in order to facilitate the heat dissipation of the heat radiation element. Further, the density ratio of the heat radiation layer to the theoretical density thereof i.e., the ratio of the actual density of the heat radiation layer to the theoretical density thereof, preferably ranges in general from 0.6 to $<1.0$, expecially from 0.7 to 0.8.

The element according to the invention can be prepared by various methods. One convenient method is to oxidize the substrate constituted by chromium-containing alloy. As described previously, preferred alloys containing chromium include iron-chromium alloy, nickel-chromium alloy and iron-nickel-chromium alloy. In order to meet the requirement that the oxides constituting the heat radiation layer should contain at least 35% by weight of chromium, the chromium content of the iron-chromium alloy should be at least 2% by weight, preferably 10% by weight or more. The chromium content of the nickel-chromium alloy should also be at least 2% by weight, preferably 5% by weight or more. On the other hand, the required chromium content of the iron-nickel-chromium alloy is 3% by weight or more, preferably 10% by weight or more.

An exessive chromium content in a chromium-containing alloy which constitutes the substrate should also be avoided in terms of the machining property of the substrate. In the case of the iron-chromium alloy, the chromium content should not exceed 35% by weight. Otherwise, $\sigma$-phase is deposited, rendering the alloy brittle. In the case of the nickel-chromium alloy, the chromium content should preferably be less than 60% by weight. When it comes to the iron-nickel-chromium alloy, the chromium content should preferably be less than 40% by weight, and in addition, the nickel content should preferably fall within the range of from 3 to 85% by weight.

The substrate oxidation is effected in general by heating the substrate in the air at 400° to 1300° C. for several seconds to several minutes, though the heating conditions will vary depending on the chromium content of the substrate alloy. Alternatively, the oxidation may be effected by heating the substrate at 800° to 1350° C. for one minute to several hours in a wet hydrogen, i.e., a mixture of hydrogen gas and water vapor, having a dew poing ranging from −10° C. to 40° C.

In general, the higher chromium content of the alloy necessitates the higher temperature for heating and the shorter heating time. Where the chromium content of the alloy ranges from 2 to 12% by weight, the heating in a wet hydrogen is imperative for attaining the desired oxidation (for example, a heating at 1200° C. for 30 minutes to 1 hour in a wet hydrogen having a dew point of 30° C. gives a satisfactory result). Where the chromium content exceeds about 12% by weight, the heating in either the air or a wet hydrogen results in a desired oxidation of the substrate. If the chromium content ranges from 12% to 17% by weight, it is satisfactory to heat the substrate in the air at, for example, 700° C. for 20 minutes or at, for example, 1200° C. for 30 minutes in a wet hydrogen having a dew point of 30° C. When the chromium content exceeds 17% by weight, it is satisfactory to heat the substrate in the air at, for example, 900° C. for 10 minutes or at, for example, 1200° C. for 10 minutes in a wet hydrogen having a dew point of 30° C.

The heating in a wet hydrogen is preferred to that in the air. If heated in a wet hydrogen, the chromium contained in the alloy tends to be oxidized selectively to a high extent, rendering it easier to meet the requirement that the resultant oxides contain 35% by weight or more of chromium based on the total weight of the metals contained in the oxides.

The oxidation treatment described above permits forming a heat radiation layer consisting of black metal oxides very tightly attached to the substrate. Generally, the heat radiation layer thus formed is 4000Å to 10000Å thick.

A heat radiation element according to this invention may also be produced by coating a substrate with chromium-containing alloy, followed by oxidizing the alloy. In this case, the coating may be effected by vapor deposition sputtering, plating, cladding or spraying. As is the case with the alloy substrate described previously, preferred alloys to be coated on the substrate are iron-chromium alloy, nickel-chromium alloy and iron-nickel-chromium alloy. The upper limit of the chromium content of the coating layer alloy need not be considered as far as the coating layer constitutes an alloy in the ordinary sence. Specifically, the chromium content should be at least 2% by weight, preferably 10% by weight or more if the coating layer is made of iron-chromium alloy. If the coating layer is formed of nickel-chromium alloy, the chromium content should be at least 2% by weight and preferably 5% by weight or more. When it comes to iron-nickel-chromium alloy, the chromium content should be 3% by weight or more, prerferably 10% by weight or more.

The substrate can be coated with chromium-containing alloy by a general method of vapor deposition, sputtering, plating, cladding or spraying. If vapor deposition is used, chromium-containing alloy of suitable composition is heated under vacuum for its evaporation and subsequent deposition on the substrate. In this case, the deposited alloy differs in composition from the alloy which is evaporated. But, the relationship in composition between the alloy acting as the vapor source and the deposited alloy may be obvious to those skilled in the art in view of Raoult's law.

In the case of sputtering, a suitable voltage is applied between an anode formed of a substrate and a cathode formed of chromium-containing alloy, thereby coating the anode with the alloy constituting the cathode. Sputtering is preferred because the alloy coated on the anode is equal in composition to the alloy constituting the cathode.

Pure chromium plating and chromium alloy plating may be used when the coating is effected by plating. The pure chromium plating is advantageous in that a chromium coating layer of a higher purity is fomred on the substrate. In this case, it is advisable to allow the substrate metal to contain a later-described emissivity-improving agent. The emissivity-improving agent contained in the substrate is diffused into the plating layer, resulting in that the oxide layer fomred in the subsequent heating step is enabled to be blackened to a satisfactory extent. In the case of the chromium-containing alloy plating, the oxide layer of the product heat radiation element is satisfactorily blackened even if the emissivity-improving agent is not contained in the plating layer. The plating method is also advantageous in that a coating layer can be formed in whatever shape desired.

In the case of cladding, a chromium-containing alloy plate and a substrate metal plate having a desired thickness ratio are superposed one upon the other and bonded together by cold cladding, hot cladding, explosion cladding, etc. The cladding method is advantageous in that a chromium-containing alloy of a desired composition and desired thickness can be bonded to the substrate metal at a relatively low cost.

The spraying method is very simple and is advantageous in expenses. It suffices to spray a chromium-containing alloy onto the substrate.

The chromium-containing alloy thus coated on the substrate is oxidized in the air or in a wet hydrogen under the conditions as described previously. If the thickness of the coating layer is 10000Å or less, substantially all the layer is oxidized to provide a heat radiation layer. However, if the coating layer is thicker than 100000Å, it sometimes happens that some part of the coating layer is not oxidized in the heating step. Throughout this specification and the claims, the term "substrate" is directed to mean the base material including the nonoxidized portion of a coating layer, if any. In other words, the "substrate" implies a body on the surface of which a heat radiation layer is to be formed.

In all the above-mentioned methods, a substrate having a chromium-containing alloy layer at least on the surface thereof is heated in an oxidative atmosphere, air or wet hydrogen, to oxidize the chromium-containing alloy.

Table A below summerizes preferred conditions for oxidizing chromium-containing alloy.

Table A

| | In wet hydrogen | | | In air | |
|---|---|---|---|---|---|
| Cr content of alloy | dew point (° C) | Heating temperature (° C) | Heating time (min.) | Heating temperature (° C) | Heating time (min.) |
| Up to 12% by weight | 20 to 40 | 1100 to 1350 | More than 1 | — | — |
| 12% to 17% by weight | 10 to 40 | 1000 to 1350 | More than 1 | 600 to 1100 | More than 0.5 |
| More than | 0 to 40 | 800 to | More | 700 to | More than |

Table A-continued

| Cr content of alloy | In wet hydrogen dew point (° C) | Heating temperature (° C) | Heating time (min.) | In air Heating temperature (° C) | Heating time (min.) |
|---|---|---|---|---|---|
| 17% by weight | | 1350 | than 1 | 1300 | 0.5 |

The oxides constituting a heat radiation layer thus formed contain at least 35% by weight of chromium based on the total weight of the metal components of the oxides, the chromium being of course in the form of oxides. Quite naturally, oxides of metals forming an alloy together with chromium, for example, oxides of iron or nickel are also contained in the heat radiation layer. The state under which these oxides are present is uncertain, but it is considered that the heat radiation layer thus formed is not a simple mixture of the oxides. The oxides are supposed to form at least partly spinel structure.

The heat radiation element according to this invention comprises a particular heat radiation layer. As described above, the heat radiation layer is constituted by oxides of chromium-containing alloy, said oxides containing at least 35% by weight of chromium based on the total amount of the metal components. A heat radiation element thus specified has at least 0.71 of total emissivity defined in the following equation (A), fully satisfying a requirement of a satisfactory heat radiation element. Incidentally, the value of $\epsilon$ for a black body is 1.

$$E = \epsilon\sigma T^4 \quad (A)$$

where

E: emissive power ($J/m^2.hr$)

$\epsilon$: total emissivity $\sigma$: Stefan-Boltzmann's constant ($Kcal/m^2.hr.K^4$)

T: temperature (K)

The total emissivity $\sigma$ of the heat radiation element is increased up to at least about 0.90 if at least one of vanadium, titanium, zirconium and niobium acting as an emissivity-improving agent is present in the heat radiation layer.

In order to allow the heat radiation layer to contain the emissivity-improving agent mentioned above it suffices to add the emissivity-improving agent to a chromium-containing alloy such as iron-chromium alloy, nickel-chromium alloy or iron-nicekl-chromium alloy, followed by the heat treatment under the conditions described previously. The additive content of the alloy should be at least 0.03% by weight, preferably 0.07% by weight or more. No detrimental effect is produced if an excessive amount of the emissivity-improving agent has been added. But, an appreciable improvement in emissivity is not recognized when the additive content exceeds 5% by weight.

The emissivity-improving agent present in the heat radiation layers is also in the form of oxide. In addition, the oxide mentioned is supposed to form a part of the lattice of the crystal of the chromium oxide, etc. As described previously, the presence of the emissivity-improving agent increases the total emissivity of the heat radiation layer up to at least about 0.90 and up to 0.98 or more, in contrast to at most 0.85 for the case of absence of the emissivity-improving agent. The most preferred emissivity-improving agents are vanadium and titanium, in particular, vanadium.

The heat radiation element according to this invention may also be prepared by directly coating a substrate with oxides of a chromium-containing alloy with or without oxide of the emissivity-improving agent in a chemical combination with the oxide of the alloy. The coating may be effected by vapor deposition, sputtering or spraying.

Specifically, oxides of chromium-containing alloy with or without an emissivity-improving agent are heated under vacuum for evaporation and subsequent-deposition on a substrate. When it comes to sputtering, an appropriate voltage is applied between a cathode formed of the oxides of the chromium-containing alloy with or without the emissivity-improving agent and an anode constituting a substrate, thereby permitting the oxide deposition on the anode (substrate). In the case of spraying the aimed oxide is directly sprayed onto a substrate and, thus, preferred in terms of cost. It is convenient to prepare the oxide for use in vapor deposition, sputtering or spraying by sintering the chromium-containing alloy, followed by oxidation of the sintered material.

The heat radiation layer consisting of oxides of the chromium-containing alloy thus prepared has a practically satisfactory value of at least 0.71 of total emissivity and, in addition, is strongly attached to the substrate. Even if rubbed or struck, the heat radiation layer does not peel off the substrate. That is, the element of the invention is resistant to physical shocks. Further, as described previously, the surface roughness of the heat radiation layer ranges in general from 0.05 to 30$\mu$, preferably from 0.3 to 5$\mu$, and the density ratio of the layer to the theoretical density thereof ranges in general from 0.6 to $<1.0$, preferably from 0.7 to 0.8. It follows that the heat radiation per apparent unit area of the surface of the heat radiation layer is increased, rendering the heat radiation layer more preferred.

The heat radiation element according to this invention can be extensively used as members requiring a good heat radiation including, for example, an anode of an electron tube, a heating wire, a boiler shell, etc. It should also be noted that a material capable of a good heat radiation is also good in heat absorption capability. In this sense, the heat radaition element of the invention can effectively be used as a heat abosorption member of, for example, a solar heat absorption apparatus.

This invention will be more fully understood from the following examples. In these examples, all percentages and parts are by weight, unless otherwise expressly stated to the contrary.

EXAMPLE 1

Workpiece samples 1 to 70 of a predetermined shape were prepared from chromium-containing alloys of the composition shown in Table 1. These samples were oxidized in a wet hydrogen or in the air under the conditions shown in Table 2, thereby obtaining the corresponding heat radiation elements 1' to 70' having heat radiation layers. Table 3 shows the chromium content, surface roughness, and total emissivity of the heat radiation layer of each of the resultant heat radiation element as well as the density ratio of the heat radiation layer to the theoretical density thereof.

Table 1

| Sample No. | Composition (%) Fe | Ni | Cr | V | Ti | Zr | Nb |
|---|---|---|---|---|---|---|---|
| 1 | Balance | — | 2 | — | — | — | — |
| 2 | " | — | 2 | 0.03 | — | — | — |
| 3 | " | — | 2 | 0.3 | 0.8 | 0.1 | 2.0 |
| 4 | " | — | 12 | 0.1 | 0.4 | 0.08 | 1.5 |
| 5 | " | — | 17 | 0.1 | 0.5 | 0.04 | 1.0 |
| 6 | " | — | 18 | — | — | — | — |
| 7 | " | — | " | 0.1 | — | — | — |
| 8 | " | — | " | — | 0.4 | — | — |
| 9 | " | — | " | — | — | 0.1 | — |
| 10 | " | — | " | — | — | — | 0.2 |
| 11 | " | — | " | 0.1 | 0.3 | — | — |
| 12 | " | — | " | 0.1 | — | 0.3 | — |
| 13 | " | — | " | 0.1 | — | — | 0.2 |
| 14 | " | — | " | — | 0.1 | 0.05 | — |
| 15 | " | — | " | — | 0.1 | — | 0.2 |
| 16 | " | — | " | — | — | 0.1 | 0.2 |
| 17 | " | — | 28 | 0.15 | 0.3 | 0.03 | 0.7 |
| 18 | " | — | 30 | 0.1 | 0.3 | 0.03 | 0.5 |
| 19 | " | — | 35 | 0.1 | 0.5 | 0.03 | 0.5 |
| 20 | — | Balance | 2 | — | — | — | — |
| 21 | — | " | 2 | — | 0.03 | — | — |
| 22 | — | " | 2 | 0.5 | 1.7 | 0.1 | 2.3 |
| 23 | — | " | 13 | 0.3 | 1.2 | 0.08 | 1.9 |
| 24 | — | " | 20 | — | — | — | — |
| 25 | — | " | " | 0.1 | — | — | — |
| 26 | — | " | " | — | 0.2 | — | — |
| 27 | — | " | " | — | — | 0.2 | — |
| 28 | — | " | " | — | — | — | 0.2 |
| 29 | — | " | " | 0.1 | 0.1 | — | — |
| 30 | — | " | " | 0.1 | — | — | 0.2 |
| 31 | — | " | " | — | 0.1 | — | 0.1 |
| 32 | — | " | " | — | 0.1 | 0.1 | — |
| 33 | — | " | " | — | — | 0.1 | 0.1 |
| 34 | — | " | " | 0.2 | 0.7 | 0.07 | 1.5 |
| 35 | — | " | 27 | 0.2 | 0.7 | 0.07 | 1.7 |
| 36 | — | " | 35 | 0.15 | 0.5 | 0.04 | 1.5 |
| 37 | — | " | 47 | 0.15 | 0.5 | 0.03 | 1.4 |
| 38 | — | " | 54 | 0.1 | 0.4 | 0.02 | 1.3 |
| 39 | — | " | 60 | — | — | — | — |
| 40 | — | " | 60 | 0.1 | 0.6 | 0.02 | 0.5 |
| 41 | Balance | 3 | 3 | 0.2 | — | — | 0.5 |
| 42 | " | 7 | 5 | — | 0.5 | — | — |
| 43 | " | 8 | 18 | — | — | — | — |
| 44 | " | " | " | 0.1 | — | — | — |
| 45 | " | " | " | — | 0.2 | — | — |
| 46 | " | " | " | — | — | 0.2 | — |
| 47 | " | " | " | — | — | — | 0.2 |
| 48 | " | " | " | 0.05 | 0.2 | — | — |
| 49 | " | " | " | 0.1 | — | — | 0.1 |
| 50 | " | " | " | — | 0.1 | 0.1 | — |
| 51 | " | " | " | — | 0.2 | — | 0.2 |
| 52 | " | " | " | — | — | 0.2 | 0.2 |
| 53 | " | " | " | 0.2 | — | — | 0.5 |
| 54 | " | 10 | 13 | — | — | 0.2 | — |
| 55 | " | 10 | 18 | — | — | 0.2 | — |
| 56 | " | 20 | 20 | — | 0.5 | — | — |
| 57 | " | 15 | 30 | 0.2 | — | — | — |
| 58 | " | 30 | 7 | — | 0.5 | — | — |
| 59 | " | 42 | 6 | — | — | 0.2 | — |
| 60 | " | 42 | 6 | — | 0.5 | — | 0.2 |
| 61 | " | 46 | 13 | — | 0.5 | — | — |
| 62 | " | 50 | 4 | — | — | 0.2 | — |
| 63 | " | 57 | 6 | 0.2 | — | — | — |
| 64 | " | 70 | 10 | — | 0.5 | — | — |
| 65 | " | 80 | 7 | — | — | — | 0.5 |
| 66 | " | 85 | 3 | — | | — | — |
| 67 | " | 85 | 3 | — | 0.5 | — | — |
| 68 | " | 15 | 35 | — | — | — | 0.5 |
| 69 | " | " | 40 | — | — | — | — |
| 70 | " | " | 40 | 0.2 | — | — | — |

Table 2

| Sample No. | Oxidation Conditions: In Wet Hydrogen dew point (° C) | temperature (° C) | heating time (min.) | In Air temperature (° C) | heating time (min.) |
|---|---|---|---|---|---|
| 1 | 30 | 1200 | 60 | | |
| 2 | " | " | " | | |
| 3 | " | " | " | | |
| 4 | | | | 800 | 3 |
| 5 | | | | " | " |
| 6 | 25 | 1200 | 30 | | |
| 7 | " | " | " | | |
| 8 | " | " | " | | |
| 9 | " | " | " | | |
| 10 | " | " | " | | |

Table 2-continued

| Sample No. | Oxidation Conditions: In Wet Hydrogen dew point (° C) | temperature (° C) | heating time (min.) | In Air temperature (° C) | heating time (min.) |
|---|---|---|---|---|---|
| 11 | " | " | " | | |
| 12 | " | " | " | | |
| 13 | " | " | " | | |
| 14 | " | " | " | | |
| 15 | " | " | " | | |
| 16 | " | " | " | | |
| 17 | " | " | " | | |
| 18 | " | " | " | | |
| 19 | " | " | " | | |
| 20 | 30 | 1200 | 60 | | |
| 21 | " | " | " | | |
| 22 | " | " | " | | |
| 23 | " | " | " | | |
| 24 | " | " | " | | |
| 25 | " | " | " | | |
| 26 | " | " | " | | |
| 27 | " | " | " | | |
| 28 | " | " | " | | |
| 29 | " | " | " | | |
| 30 | | | | 900 | 1 |
| 31 | | | | " | " |
| 32 | | | | " | " |
| 33 | 30 | 1200 | 60 | | |
| 34 | " | " | " | | |
| 35 | " | " | " | | |
| 36 | " | " | " | | |
| 37 | " | " | " | | |
| 38 | " | " | " | | |
| 39 | " | " | " | | |
| 40 | " | " | " | | |
| 41 | " | " | " | | |
| 42 | " | " | " | | |
| 43 | | | | 800 | 2 |
| 44 | | | | " | " |
| 45 | | | | " | " |
| 46 | 30 | 1150 | 60 | | |
| 47 | " | " | " | | |
| 48 | " | " | " | | |
| 49 | " | " | " | | |
| 50 | " | " | " | | |
| 51 | " | " | " | | |
| 52 | " | " | " | | |
| 53 | " | " | " | | |
| 54 | " | " | " | | |
| 55 | " | " | " | | |
| 56 | " | " | " | | |
| 57 | " | " | " | | |
| 58 | " | " | " | | |
| 59 | " | " | " | | |
| 60 | " | " | " | | |
| 61 | " | " | " | | |
| 62 | " | " | " | | |
| 63 | " | " | " | | |
| 64 | " | " | " | | |
| 65 | " | " | " | | |
| 66 | " | " | " | | |
| 67 | " | " | " | | |
| 68 | " | " | " | | |
| 69 | | | | 900 | 1 |
| 70 | | | | " | " |

Table 3

| Product No. | Cr Content of Oxides (%) | Surface Roughness (μ) | Density Ratio | Total Emissivity |
|---|---|---|---|---|
| 1 | 70 | 5 | 0.65 | 0.72 |
| 2 | 70 | 10 | 0.7 | 0.88 |
| 3 | 60 | 10 | 0.7 | 0.89 |
| 4 | 35 | 5 | 0.7 | 0.89 |
| 5 | 50 | 17 | 0.7 | 0.89 |
| 6 | 70 | 2 | 0.8 | 0.73 |
| 7 | 75 | 0.3 | 0.8 | 0.93 |
| 8 | " | 1 | 0.7 | 0.89 |
| 9 | " | 4 | 0.7 | 0.93 |
| 10 | " | 5 | 0.7 | 0.90 |
| 11 | " | 1 | 0.8 | 0.95 |
| 12 | " | 1 | 0.8 | 0.98 |
| 13 | " | 10 | 0.7 | 0.98 |
| 14 | " | | 0.6 | 0.91 |
| 15 | " | 5 | 0.8 | 0.89 |
| 16 | " | 5 | 0.8 | 0.90 |
| 17 | 80 | 7 | 0.8 | 0.98 |
| 18 | " | 2 | 0.8 | 0.98 |
| 19 | 70 | 20 | 0.7 | 0.90 |
| 20 | 70 | 10 | 0.7 | 0.73 |

Table 3-continued

| Product No. | Cr Content of Oxides (%) | Surface Roughness (μ) | Density Ratio | Total Emissivity |
|---|---|---|---|---|
| 21 | 75 | 10 | 0.8 | 0.88 |
| 22 | 75 | 19 | 0.7 | 0.93 |
| 23 | 75 | 15 | 0.6 | 0.97 |
| 24 | 80 | 10 | 0.7 | 0.71 |
| 25 | 75 | 0.05 | 0.8 | 0.93 |
| 26 | 75 | 0.08 | 0.8 | 0.88 |
| 27 | 75 | 0.8 | 0.9 | 0.89 |
| 28 | 75 | 1.5 | 0.9 | 0.93 |
| 29 | 75 | 4.5 | 0.8 | 0.95 |
| 30 | 75 | 20 | 0.8 | 0.95 |
| 31 | 78 | 25 | 0.8 | 0.93 |
| 32 | 78 | 25 | 0.8 | 0.89 |
| 33 | 76 | 3 | 0.8 | 0.90 |
| 34 | 76 | 11 | 0.7 | 0.96 |
| 35 | 77 | 20 | 0.7 | 0.93 |
| 36 | 75 | 5 | 0.8 | 0.97 |
| 37 | 75 | 4 | 0.8 | 0.97 |
| 38 | 95 | 20 | 0.7 | 0.97 |
| 39 | 99 | 10 | 0.8 | 0.72 |
| 40 | 95 | 5 | 0.8 | 0.98 |
| 41 | 75 | 10 | 0.8 | 0.93 |
| 42 | 75 | 5 | 0.8 | 0.90 |
| 43 | 40 | 30 | 0.7 | 0.75 |
| 44 | 50 | 25 | 0.7 | 0.88 |
| 45 | 35 | 25 | 0.7 | 0.88 |
| 46 | 70 | 7 | 0.8 | 0.90 |
| 47 | 60 | 6 | 0.8 | 0.90 |
| 48 | 60 | 5 | 0.8 | 0.93 |
| 49 | 80 | 5 | 0.9 | 0.97 |
| 50 | 75 | 4 | 0.8 | 0.93 |
| 51 | 75 | 4 | 0.8 | 0.89 |
| 52 | 75 | 4 | 0.8 | 0.88 |
| 53 | 75 | 3 | 0.9 | 0.90 |
| 54 | 60 | 3 | 0.8 | 0.90 |
| 55 | 65 | 5 | 0.8 | 0.88 |
| 56 | 70 | 5 | 0.7 | 0.90 |
| 57 | 75 | 5 | 0.7 | 0.90 |
| 58 | 80 | 4 | 0.8 | 0.92 |
| 59 | 85 | 2 | 0.8 | 0.90 |
| 60 | 90 | 1 | 0.8 | 0.93 |
| 61 | 75 | 3 | 0.8 | 0.95 |
| 62 | 80 | 7 | 0.8 | 0.90 |
| 63 | 70 | 5 | 0.8 | 0.90 |
| 64 | 70 | 4 | 0.8 | 0.89 |
| 65 | 40 | 10 | 0.7 | 0.90 |
| 66 | 60 | 10 | 0.7 | 0.71 |
| 67 | 60 | 7 | 0.8 | 0.90 |
| 68 | 70 | 7 | 0.8 | 0.89 |
| 69 | 80 | 10 | 0.8 | 0.78 |
| 70 | 80 | 10 | 0.8 | 0.95 |

EXAMPLE 2

An iron plate substrate 0.5 mm thick was coated with 0.2%V-18%Cr-Fe alloy by an ordinary sputtering method, the coating layer being 5μ thick and, then, heated to 1200° C. for 1 hour in a wet hydrogen having a dew point of 30° C. Substantially all the chromium and vanadium contained in the coating layer were found oxidized by the heat treatment so as to provide an oxide layer 5μ thick. Table 4 shows the properties of the resultant heat radiation element.

EXAMPLE 3

An iron plate substrate 0.5 mm thick was coated by a sputtering method with the oxide obtained as product 40' in Example 1. The coating layer was 8000Å thick. Table 4 shows the properties of the resultant heat radiation element.

EXAMPLE 4

An iron alloy substrate containing 1% of vanadium and having a thickness of 0.5 mm was plated with chromium to provide a plating layer 2μ thick and, then, heated at 1200° C. for 3 hours in a wet hydrogen having a dew point of 20° C. Oxides of chromium and vanadium were found contained in the surface oxide layer. Table 4 shows the properties of the resultant heat radiation element.

EXAMPLE 5

An iron plate 0.5 mm thick was plated with an alloy of 0.5%Zr-20%Cr-Fe, the plating layer being 3μ thick, and, then, heated in the air at 800° C. for 3 minutes. Oxides of chromium and zirconium were found contained in the surface oxide layer. Table 4 shows the properties of the resultant heat radiation layer.

EXAMPLE 6

An alloy of 0.1%V-20%Cr-Ni having a thickness of 0.1 mm was bonded to a nickel plate 0.5 mm thick by cold cladding and, then, heated at 1200° C. for 1 hour in a wet hydrogen having a dew point of 30° C. The alloy plate alone was found selectively oxidized, with the nickel plate non-oxidized. Oxides of chromium and vanadium were contained in the resultant oxide layer. Table 4 shows the properties of the heat radiation element thus obtained.

EXAMPLE 7

The alloy of sample 40 shown in Table 1 of Example 1 was sprayed onto an iron plate 0.5 mm thick to form a sprayed layer 10μ thick and, then, heated under the conditions shown in Table 2, sample 40, of Example 1. Table 4 shows the properties of the resultant heat radiation element.

EXAMPLE 8

An iron plate 0.5 mm thick was coated with $MnO.Cr_2O_3$ layer 0.2 mm thick by spraying. Table 4 shows the properties of the resultant heat radiation element.

EXAMPLE 9

An iron plate 0.5 mm thick was coated with an alloy layer 5μ thick consisting of 0.2%V-18%Cr-Fe by vapor deposition, followed by heating at 1200° C. for 1 hour in a wet hydrogen having a dew point of 30° C. The resultant oxide layer was 5μ thick. Table 4 shows the properties of the heat radiation element thus obtained.

Table 4

| Example No. | Cr Content of Oxides | Surface Roughness (μ) | Density Ratio | Total Emissivity |
|---|---|---|---|---|
| 2 | 75 | 20 | 0.8 | 0.91 |
| 3 | 94 | 10 | 0.9 | 0.97 |
| 4 | 78 | 25 | 0.8 | 0.90 |
| 5 | 70 | 25 | 0.7 | 0.90 |
| 6 | 75 | 0.3 | 0.8 | 0.93 |
| 7 | 90 | 30 | 0.8 | 0.95 |
| 8 | 70 | 30 | 0.8 | 0.89 |
| 9 | 75 | 20 | 0.8 | 0.91 |

What we claim is:

1. A heat radiation anode element comprising a substrate and a heat radiation layer formed on the substrate and comprising oxides of a chromium-containing alloy, the heat radiation layer containing at least 35% by weight of chromium based on the total weight of the metal components of the oxides, and an emissivity-improving agent selected from the group consisting of vanadium, titanium, zirconium, niobium and mixtures thereof, in an amount sufficient to improve the total emissivity of said heat radiation element.

2. The anode element according to claim 1, wherein vanadium is the emissivity-improving agent.

3. The anode element according to claim 1, wherein the chromium-containing alloy contains from 0.03 to 5% by weight of said emissivity-improving agent.

4. The anode element according to claim 1, wherein the chromium-containing alloy is an iron-chromium alloy, a nickel-chromium alloy or an iron-nickel-chromium alloy.

5. The anode element according to claim 1, wherein the substrate is iron, nickel, chromium, copper, aluminum, silver, an iron-chromium alloy, a nickel-chromium alloy or an iron-nickel-chromium alloy.

6. A heat radiation anode element comprising:

a substrate formed of a member selected from the group consisting of iron, nickel, chromium, copper, aluminum, silver, an iron-chromium alloy, a nickel-chromium alloy and an iron-nickel-chromium alloy; and a heat radiation layer formed on and tightly attached to the substrate consisting essentially of the oxides of a chromium-containing alloy selected from the group consisting of an iron-chromium alloy, a nickel-chromium alloy and an iron-nickel-chromium alloy, the chromium-containing alloy further containing 0.03 to 5% by weight of a member selected from the group consisting of vanadium, titanium, zirconium, niobium and mixtures thereof, the oxides constituting the heat radiation layer which itself contains at least 35% by weight of chromium in the form of oxides based on the total weight of the metal component of the oxides, the layer having a surface roughness of 0.3 to 5μ and a total emissivity of at least about 0.9, the ratio in density of the heat radiation layer to its theoretical density ranging from 0.7 to 0.8.

7. The anode element according to claim 6 wherein the chromium-containing alloy is an iron-chromium alloy containing at least 2% by weight of chromium.

8. The anode element according to claim 6, wherein the chromium-containing alloy is an iron-chromium alloy containing at least 10% by weight of chromium.

9. The anode element according to claim 6, wherein the chromium-containing alloy is a nickel-chromium alloy containing at least 2% by weight of chromium.

10. The anode element according to claim 6, wherein the chromium-containing alloy is a nickel-chromium alloy containing at least 5% by weight of chromium.

11. The anode element according to claim 6, wherein the chromium-containing alloy is an iron-nickel-chromium alloy containing at least 3% by weight of chromium.

12. The anode element according to claim 6, wherein the chromium-containing alloy is an iron-nickel-chromium alloy containing at least 10% by weight of chromium.

13. The anode element according to claim 6 wherein the chromium content of the heat radiation layer ranges from 60% to 99% by weight.

14. The anode element according to claim 6, wherein vanadium is the emissivity-improving agent.

15. A heat radiation anode element comprising, in combination:

a substrate; and a heat radiation layer formed on and tightly attached thereto, said layer constituted of a chromium-containing alloy selected from the group consisting of an iron-chromium alloy, a nickel-chromium alloy and an iron-nickel-chromium alloy, said layer containing from 35 to 99% by weight of chromium in the form of oxides thereof based on the total weight of the metal components of the oxides, said alloy further containing an emissivity-improving agent selected from the group consisting of vanadium, titanium, zironium, niobium and mixtures thereof, said emissivity-improving agent present in an amount such that the total emissivity of said layer is 0.71 to 0.98, said layer having a surface roughness of 0.3 to 5μ and the ratio in density of the heat radiation layer to its theoretical density is from 0.6 to less than 1.

16. The anode element according to claim 15, wherein the chromium content of said layer is in the range of 60 to 99% by weight.

17. The anode element according to claim 15, wherein the surface roughness is in the range of 0.3 to 5μ.

18. The anode element according to claim 15, wherein the ratio of density of the heat radiation layer to its theoretical density is form 0.7 to 0.8.

19. The anode element according to claim 15 wherein said emissivity-improving agent is present in an amount of from 0.03 to 5% by weight.

20. The anode element according to claim 15 wherein the total emissivity of said layer is in the range of 0.90 to 0.98.

21. The anode element according to claim 15, wherein said substrate is selected from the group consisting of iron, nickel, copper, chromium, aluminum, silver, an iron-chromium alloy, a nickel-chromium alloy and an iron-nickel-chromium alloy.

22. A heat radiation anode element comprising, in combination:

a substrate; and a heat radiation layer formed on and tightly attached thereto, said layer constituted of a chromium-containing alloy selected from the group consisting of an iron-chromium alloy, a nickel-chromium alloy and an iron-nickel-chromium alloy, said layer containing from 60 to 99% by weight of chromium in the form of oxides thereof based on the total weight of the metal components of the oxides, said alloy further containing from 0.03 to 5% by weight of an emissivity-improving agent selected from the group consisting of vanadium, titanium, zironium, niobium and mixtures thereof, said emissivity-improvement agent present in an amount such that the total emissivity of said layer is 0.71 to 0.98, said layer having a surface roughness of 0.3 to 5μ and the ratio in density of the heat radiation layer to its theoretical density is from 0.6 to less than 1.

* * * * *

UNITED STATES PATENT OFFICE

CERTIFICATE OF CORRECTION

Patent No. 4,119,761 Dated October 10, 1978

Inventor(s) Kuze et al

It is certified that error appears in the above-identified patent and that said Letters Patent are hereby corrected as shown below:

Please insert on the face of the grant:

-- Foreign Application Priority Data

November 26, 1976 Japan 51-141832

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*